US011431072B2

(12) United States Patent
Tokuda

(10) Patent No.: US 11,431,072 B2
(45) Date of Patent: Aug. 30, 2022

(54) DIRECTIONAL COUPLER AND MODULE

(71) Applicant: Murata Manufacturing Co., Ltd., Kyoto (JP)

(72) Inventor: Daisuke Tokuda, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 16/986,738

(22) Filed: Aug. 6, 2020

(65) Prior Publication Data

US 2020/0365963 A1 Nov. 19, 2020

Related U.S. Application Data

(63) Continuation of application No. PCT/JP2019/001881, filed on Jan. 22, 2019.

(30) Foreign Application Priority Data

Feb. 7, 2018 (JP) ..... JP2018-020299

(51) Int. Cl.
*H01P 5/18* (2006.01)

(52) U.S. Cl.
CPC ..... *H01P 5/18* (2013.01)

(58) Field of Classification Search
CPC ..... H01P 5/18
See application file for complete search history.

(56) References Cited

U.S. PATENT DOCUMENTS 4,216,446 A * 8/1980 Iwer ..... H01P 5/185 333/112
4,376,921 A 3/1983 Dickens et al.
6,825,738 B2 * 11/2004 Shumovich ..... H01P 5/185 333/112
7,187,250 B2 * 3/2007 Matters-Kammerer ..... H03H 7/48 333/116
7,187,910 B2 * 3/2007 Kim ..... H01P 5/185 455/115.3
9,503,044 B2 11/2016 Granger-Jones et al.
2010/0033265 A1 2/2010 Hash
2010/0171564 A1 7/2010 Yamamoto et al.
2012/0161898 A1 6/2012 Gorbachov
2015/0236711 A1 8/2015 Aruga et al.
(Continued)

FOREIGN PATENT DOCUMENTS

CN 103972632 A 8/2014
JP S57-180202 A 11/1982
(Continued)

OTHER PUBLICATIONS

International Search Report issued in Application No. PCT/JP2019/001881, dated Mar. 26, 2019.
(Continued)

*Primary Examiner* — Stephen E. Jones
(74) *Attorney, Agent, or Firm* — Pearne & Gordon LLP

(57) ABSTRACT

A directional coupler (10) includes a main line (20), a sub-line (40), and a variable capacitor (60). At least part of the sub-line (40) is disposed along the main line (20). The variable capacitor (60) is connected between the main line (20) and the sub-line (40). The directional coupler (10) achieves a stable degree of coupling between the main line (20) and the sub-line (40).

9 Claims, 7 Drawing Sheets

(56) References Cited

U.S. PATENT DOCUMENTS

| | | | |
|---|---|---|---|
| 2016/0028147 | A1 | 1/2016 | Srirattana et al. |
| 2017/0287854 | A1 | 10/2017 | Srirattana et al. |

FOREIGN PATENT DOCUMENTS

| | | | |
|---|---|---|---|
| JP | S59-128804 | A | 7/1984 |
| JP | H09-107212 | A | 4/1997 |
| JP | 2009-027617 | A | 2/2009 |
| JP | 2010-161466 | A | 7/2010 |
| JP | 2015-154058 | A | 8/2015 |

OTHER PUBLICATIONS

Written Opinion issued in Application No. PCT/JP2019/001881, dated Mar. 26, 2019.

* cited by examiner

DIRECTIONAL COUPLER AND MODULE

This is a continuation of International Application No. PCT/JP2019/001881 filed on Jan. 22, 2019 which claims priority from Japanese Patent Application No. 2018-020299 filed on Feb. 7, 2018. The contents of these applications are incorporated herein by reference in their entireties.

BACKGROUND OF THE DISCLOSURE

Field of the Disclosure

The present disclosure relates to a directional coupler and a module including the same.

Description of the Related Art

Hitherto, in a wireless communication mobile terminal, such as a smartphone or a tablet terminal, a directional coupler is used for monitoring output of a radio-frequency signal to be transmitted from the mobile terminal. In response to a demand for the miniaturization of mobile terminals, components used in mobile terminals, such as directional couplers, are also being reduced in size.

A directional coupler includes a main line and a sub-line disposed in parallel with the main line, for example. In this type of directional coupler, by way of magnetic coupling and capacitive coupling between the main line and the sub-line, part of a radio-frequency signal transmitted through the main line can be coupled with the sub-line. In a small-size directional coupler, the distance between the main line and the sub-line is small so as to increase the capacitance therebetween. The main line and the sub-line are thus likely to be coupled with each other mainly via capacitive coupling rather than magnetic coupling. This degrades the directivity of the directional coupler. To solve such a problem, in the directional coupler disclosed in Patent Document 1, a capacitor device is disposed between the output terminal of a main line and a detection terminal of a sub-line. Because of the provision of this capacitor device, components of a radio-frequency signal outputted to the detection terminal by capacitive coupling between the main line and the sub-line and components of the radio-frequency signal outputted to the detection terminal via the capacitor device are canceled out each other, thereby making capacitive coupling between the main line and the sub-line occur less frequently. As a result, the directivity of the directional coupler is maintained.

Patent Document 1: Japanese Unexamined Patent Application Publication No. 2009-27617

BRIEF SUMMARY OF THE DISCLOSURE

In a directional coupler, the degree of coupling between the main line and the sub-line is varied in accordance with the frequency of an input radio-frequency signal. The degree of coupling also changes depending on the mounting state of a directional coupler. For example, in accordance with the state of wiring laid and connected to a detection terminal, resistor components of the wiring vary. This may reduce the degree of coupling between the main line and the sub-line. If the degree of coupling is changed in this manner, a desired degree may not be obtained from the directional coupler including a fixed magnitude of capacitance disclosed in Patent Document 1, and the high directivity may not be maintained.

It is an object of the present disclosure to provide a directional coupler that achieves a stable degree of coupling between a main line and a sub-line even with factors that may vary the degree of coupling and also to provide a module including the directional coupler.

In order to achieve the above-described object, a directional coupler according to one aspect of the present disclosure includes a main line, a sub-line, and a variable capacitor. At least part of the sub-line is disposed along the main line. The variable capacitor is connected between the main line and the sub-line.

In this directional coupler, the degree of coupling between the main line and the sub-line can be adjusted by the variable capacitor. Hence, even with factors that may vary the degree of coupling, a stable degree of coupling can be obtained.

In a directional coupler according to one aspect of the present disclosure, the main line may include an input end portion, an output end portion, and a main wiring. The input end portion is one end portion of the main line, while the output end portion is the other end portion of the main line. The main wiring links the input end portion and the output end portion. The sub-line may include a first end portion, a second end portion, and a sub-wiring. The first end portion is one end portion of the sub-line, while the second end portion is the other end portion of the sub-line. The sub-wiring links the first and second end portions. The variable capacitor may include first and second input/output electrodes. The first input/output electrode may be connected to the main wiring, while the second input/output electrode may be connected to the sub-wiring.

In this directional coupler, to reduce variations in the degree of coupling caused by wiring connected to each of the input and output end portions of the main line and the first and second end portions of the sub-line, each of these four end portions is disposed separately from the other three end portions as far as possible. For this reason, in this configuration, the variable capacitor is connected between the main wiring of the main line and the sub-wiring of the sub-line. The length of wiring between the variable capacitor and the main line and that between the variable capacitor and the sub-line can thus be made smaller, compared with when the variable capacitor is connected to the other portions of the main line and the sub-line, such as an end portion of the main line and an end portion of the sub-line. Accordingly, parasitic inductance in each wiring can be reduced, which facilitates the adjustment of the degree of coupling of the directional coupler, thereby achieving an even stabler degree of coupling.

A directional coupler according to one aspect of the present disclosure may further include a substrate. The main line, the sub-line, and the variable capacitor may be directly or indirectly disposed on the substrate. In a plan view of the substrate, the variable capacitor may be disposed in a region sandwiched between the main line and the sub-line.

With this positional arrangement, the variable capacitor can be located relatively close to both of the main line and the sub-line. The length of the wiring between the variable capacitor and the main line and that between the variable capacitor and the sub-line can be decreased. Accordingly, parasitic inductance in each wiring can be reduced, which facilitates the adjustment of the degree of coupling of the directional coupler, thereby achieving an even stabler degree of coupling. With this positional arrangement, the provision of the variable capacitor does not significantly increase the area of the directional coupler, thereby making it possible to reduce the size of the directional coupler.

A directional coupler according to one aspect of the present disclosure may further include multiple layers stacked on the substrate. The main line and the sub-line may be disposed on different layers of the multiple layers.

In this manner, among the multiple layers, the main line and the sub-line are disposed on different layers. This can decrease the distance between the main line and the sub-line while achieving the insulation therebetween by insulating layers. It is thus possible to secure electromagnetic coupling between the main line and the sub-line and also to reduce the size of the directional coupler.

In a directional coupler according to one aspect of the present disclosure, the variable capacitor may include multiple capacitor elements connected in parallel with each other. Each of the multiple capacitor elements may include a pair of opposing electrodes. The opposing electrodes are disposed on one of the multiple layers or different layers of the multiple layers.

With this configuration, not only the main line and the sub-line, but also the capacitor elements of the variable capacitor are disposed within the multiple layers. This can further reduce the size of the directional coupler. Additionally, the distance between the variable capacitor and each of the main line and the sub-line can be made smaller than when the variable capacitor is disposed outside the plural layers, thereby further reducing the length of wiring connecting the main line and the variable capacitor and that connecting the sub-line and the variable capacitor. Accordingly, parasitic inductance in each wiring can be reduced, which facilitates the adjustment of the degree of coupling of the directional coupler, thereby achieving an even stabler degree of coupling.

In a directional coupler according to one aspect of the present disclosure, the variable capacitor may include a control terminal into which a control signal is inputted. The capacitance value of the variable capacitor may be changed based on the control signal.

With this configuration, as a result of inputting a control signal from an external source, the capacitance of the variable capacitor can be adjusted.

A module according to one aspect of the present disclosure may include the above-described directional coupler and a control circuit that outputs the control signal.

By outputting a control signal from the control circuit, the module can adjust the degree of coupling of the directional coupler.

According to the present disclosure, it is possible to provide a directional coupler that achieves a stable degree of coupling between a main line and a sub-line even with factors that may vary the degree of coupling and also to provide a module including the directional coupler.

DETAILED DESCRIPTION OF THE DISCLOSURE

Figure 1:
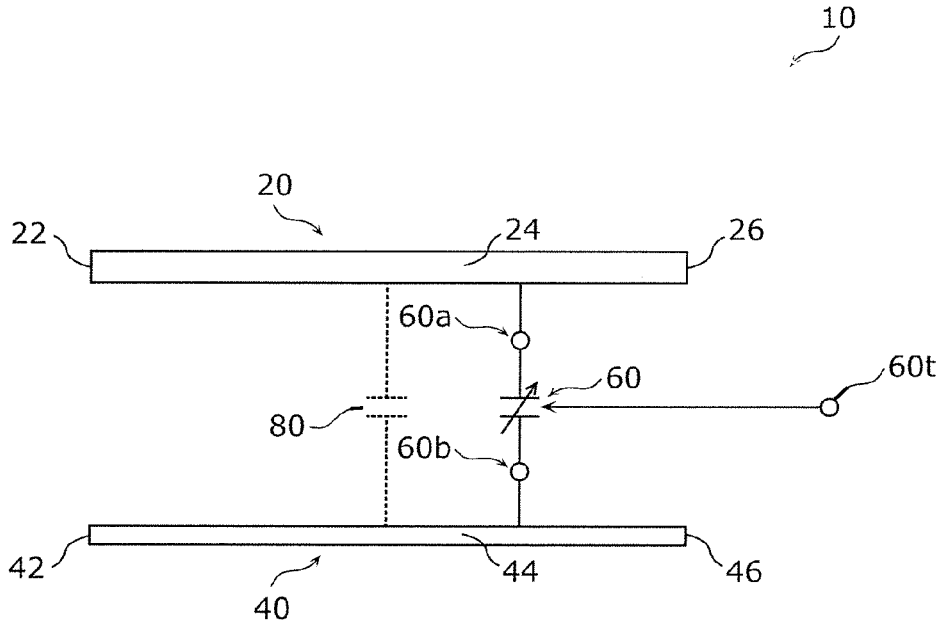
FIG. 1 is a schematic diagram illustrating the functional configuration of a directional coupler according to a first embodiment.

Embodiments of the present disclosure will be described below in detail through illustration of examples with reference to the drawings. All of the embodiments described below illustrate general or specific examples. Numeric values, configurations, materials, elements, and positions and connection states of the elements illustrated in the following embodiments are only examples and are not described for limiting the present disclosure. Among the elements illustrated in the following embodiments, the elements that are not recited in the independent claims will be described as optional elements. The sizes and dimensional ratios of the elements in the drawings are not necessarily illustrated as actual sizes and ratios. In the drawings, substantially the same elements are designated by like reference numeral, and an explanation of such elements will not be repeated or be merely simplified.

First Embodiment

A directional coupler according to a first embodiment will be described below.

[1-1. Overall Configuration]

Figure 2A:
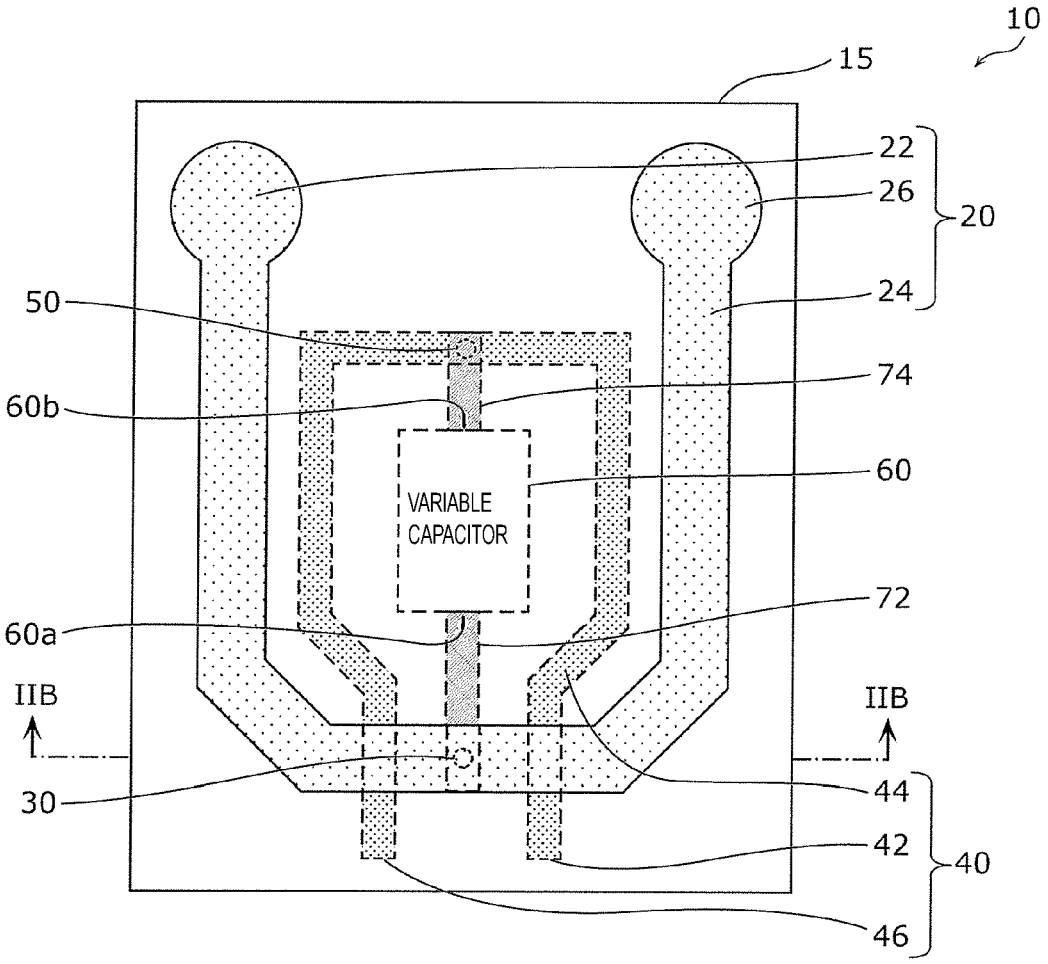
FIG. 2A is a schematic plan view illustrating the structure of the directional coupler according to the first embodiment.
Figure 2B:
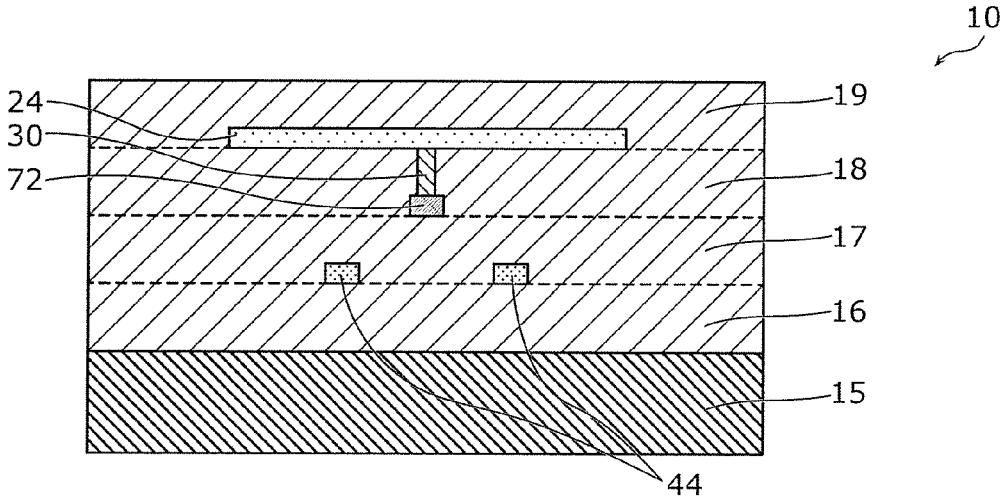
FIG. 2B is a schematic sectional view illustrating the structure of the directional coupler according to the first embodiment.

The configuration of the directional coupler according to this embodiment will first be described below with reference to FIGS. 1, 2A, and 2B. FIG. 1 is a schematic diagram illustrating the functional configuration of a directional coupler 10 according to this embodiment. FIGS. 2A and 2B are a schematic plan view and a schematic sectional view, respectively, illustrating the structure of the directional coupler 10 according to this embodiment. FIG. 2B illustrates a cross section taken in line IIB-IIB in FIG. 2A.

As shown in FIG. 1, the directional coupler 10 of this embodiment includes a main line 20, a sub-line 40 to be electromagnetically coupled with the main line 20, and a variable capacitor 60 connected between the main line 20 and the sub-line 40. In this embodiment, the directional coupler 10 is a dual directional coupler that can extract part of a radio-frequency signal transmitted through the main line 20 in each of the directions. The main line 20 and the sub-line 40 can be coupled with each other in a high frequency range by electromagnetic coupling including capacitive coupling. In FIG. 1, capacitive coupling between the main line 20 and the sub-line 40 is represented by a virtual capacitor 80 indicated by the dotted lines.

The main line 20, which is a line through which a radio-frequency signal is transmitted, can be electromagnetically coupled with the sub-line 40. That is, the main line 20 can be coupled with the sub-line 40 at least in one of the magnetic coupling mode and the capacitive coupling mode. In this embodiment, the main line 20 includes an input end portion 22, an output end portion 26, and a main wiring 24. The input end portion 22 is one end portion of the main line 20, while the output end portion 26 is the other end portion of the main line 20. The main wiring 24 links the input end portion 22 and the output end portion 26 with each other. The input end portion 22 and the output end portion 26 include, not only the corresponding ends of the main line 20, but also areas in the vicinities of these ends. More specifically, each of the input and output end portions 22 and 26 has an area having a distance of about the same size as the width of the main wiring 24 or smaller from its end.

The sub-line 40 is a line which is at least partially disposed along the main line 20. The meaning of "the sub-line 40 is disposed along the main line 20" may be that the sub-line 40 is disposed along the main line 20 with substantially a certain distance therebetween or that the sub-line 40 is disposed substantially in parallel with the main line 20. "Substantially a certain distance" means that the allowance of the distance is 10% or smaller. "The sub-line 40 is disposed substantially in parallel with the main line 20" means that the allowance of the angle between the sub-line 40 and the main line 20 is 10° or smaller. In this embodiment, the sub-line 40 includes a first end portion 42, a second end portion 46, and a sub-wiring 44. The first end portion 42 is one end portion of the sub-line 40, while the second end portion 46 is the other end portion of the sub-line 40. The sub-wiring 44 links the first and second end portions 42 and 46 with each other. Part of a radio-frequency signal transmitted from the input end portion 22 to the output end portion 26 of the main line 20 is outputted from the first end portion 42. Part of a radio-frequency signal transmitted from the output end portion 26 to the input end portion 22 of the main line 20 is outputted from the second end portion 46. The first end portion 42 and the second end portion 46 include, not only the respective ends of the sub-line 40, but also areas in the vicinities of these ends. More specifically, each of the first and second end portions 42 and 46 has an area having a distance of about the same size as the width of the sub-wiring 44 or smaller from its end.

The variable capacitor 60 is a capacitor device whose capacitance can be changed. In this embodiment, the variable capacitor 60 includes a control terminal 60*t* into which a control signal is inputted. The capacitance of the variable capacitor 60 is changed based on the control signal. The variable capacitor 60 includes first and second input/output electrodes 60*a* and 60*b*, which serve as connecting terminals with wiring, for example. That is, in the variable capacitor 60, the capacitance between the first and second input/output electrodes 60*a* and 60*b* can be changed. In this embodiment, the first input/output electrode 60*a* connects to the main wiring 24, while the second input/output electrode 60*b* connects to the sub-wiring 44. The detailed configuration of the variable capacitor 60 will be discussed later.

In this manner, in this embodiment, the degree of coupling between the main line 20 and the sub-line 40 can be adjusted by the variable capacitor 60. Hence, even with factors that may vary the degree of coupling, a stable degree of coupling can be obtained. Additionally, in this embodiment, in response to a control signal from an external source, the capacitance of the variable capacitor 60 can be adjusted. In other words, in response to a control signal from an external source, the degree of coupling of the directional coupler 10 can be adjusted.

In the directional coupler 10, to reduce variations in the degree of coupling caused by wiring to be connected to each of the input and output end portions 22 and 26 of the main line 20 and the first and second end portions 42 and 46 of the sub-line 40, each of these four end portions is disposed separately from the other three end portions as far as possible. For this reason, the variable capacitor 60 is connected between the main wiring 24 of the main line 20 and the sub-wiring 44 of the sub-line 40. The length of wiring between the variable capacitor 60 and the main line 20 and that between the variable capacitor 60 and the sub-line 40 can thus be made smaller, compared with when the variable capacitor 60 is connected to the other portions of the main line 20 and the sub-line 40, such as an end portion of the main line 20 and an end portion of the sub-line 40. Accordingly, parasitic inductance in the wiring can be reduced, which facilitates the adjustment of the degree of coupling of the directional coupler 10, thereby achieving an even stabler degree of coupling.

As shown in FIGS. 2A and 2B, the directional coupler 10 of this embodiment includes a substrate 15 for mounting the main line 20 and the sub-line 40 thereon. The main line 20, the sub-line 40, and the variable capacitor 60 may be directly or indirectly disposed on the substrate 15. As shown in FIG. 2B, the directional coupler 10 of this embodiment includes multiple insulating layers 16 through 19 sequentially stacked on the substrate 15. The main line 20 and the sub-line 40 are disposed on different layers among the multiple insulating layers 16 through 19.

The substrate 15 is a semiconductor substrate made of Si, for example. The insulating layers 16 through 19 are insulating films which are sequentially stacked on the substrate 15 to insulate plural wiring patterns from each other. Elements, such as the main line 20 and the sub-line 40, forming the directional coupler 10 are fabricated according to a known semiconductor process by forming multiple wiring layers on the substrate 15 with the insulating layers interposed therebetween. Materials for the multiple insulating layers 16 through 19 are not particularly restricted, and the insulating layers 16 through 19 may be made of the same material or different materials. If the multiple insulating layers 16 through 19 are made of the same material, the interfaces between adjacent insulating layers may become invisible. In FIG. 2B, the interfaces between adjacent insulating layers are indicated by the broken lines.

As shown in FIG. 2A, in this embodiment, regarding the main line 20, the input and output end portions 22 and 26 shown on the upper side in FIG. 2A are linked with each other by the main wiring 24 formed in a U shape. Regarding the sub-line 40, the first and second end portions 42 and 46 shown on the lower side in FIG. 2A are linked with each other by the sub-wiring 44 formed in a U shape. The most part of the sub-wiring 44 formed in a U shape is disposed in a region surrounded by a line segment which connects the main wiring 24 and each of the input and output end portions 22 and 26. The variable capacitor 60 is disposed in a region surrounded by a line segment which connects the sub-wiring 44 and each of the first and second end portions 42 and 46 and by a line segment which connects the main wiring 24 and each of the input and output end portions 22 and 26. The first input/output electrode 60*a* of the variable capacitor 60 is connected to the main wiring 24 via wiring 72, while the second input/output electrode 60*b* is connected to the sub-wiring 44 via wiring 74.

The main line 20, the sub-line 40, and the variable capacitor 60 may be directly disposed on the substrate 15.

As described above, the main line 20 is directly or indirectly disposed on the substrate 15 (in this embodiment, on the insulating layer 18 stacked above the substrate 15), and, in a plan view of the substrate 15, the variable capacitor 60 is disposed in a region sandwiched between the main line 20 and the sub-line 40. In other words, as shown in FIG. 2A, the variable capacitor 60 is disposed in a region sandwiched between the main line 20 and the sub-line 40 in a plan view of the substrate 15. With this positional arrangement, the variable capacitor 60 can be located relatively close to both of the main line 20 and the sub-line 40. The length of the wiring 72 between the variable capacitor 60 and the main line 20 and that of the wiring 74 between the variable capacitor 60 and the sub-line 40 can be decreased. Accordingly, parasitic inductance in each of the wiring 72 and the wiring 74 can be reduced, which facilitates the adjustment of the degree of coupling of the directional coupler 10, thereby achieving an even stabler degree of coupling. With the above-described positional arrangement, the provision of the variable capacitor 60 does not significantly increase the area of the directional coupler 10, thereby making it possible to reduce the size of the directional coupler 10.

In the example in FIG. 2A, the variable capacitor 60 is disposed in a region entirely surrounded by the main line 20 and the sub-line 40 in a plan view of the substrate 15. However, the region where the variable capacitor 60 is disposed may not necessarily be entirely surrounded by the main line 20 and the sub-line 40. As long as the region where the variable capacitor 60 is disposed is sandwiched between the main line 20 and the sub-line 40, the above-described advantages are achieved.

As shown in FIGS. 2A and 2B, the wiring 72 connected to the variable capacitor 60 is connected to the main wiring 24 through a via-hole wiring 30, while the wiring 74 connected to the variable capacitor 60 is connected to the sub-wiring 44 through a via-hole wiring 50. As shown in FIG. 2B, the via-hole wiring 30 is a columnar wiring passing through the insulating layer 18. The via-hole wiring 50 is a columnar wiring passing through the insulating layer 17, though it is not shown in FIG. 2B. The variable capacitor 60 may be disposed on the same layer as that on which at least one of the main line 20 and the sub-line 40 is disposed.

As shown in FIG. 2B, in this embodiment, the main wiring 24 is disposed between the insulating layers 18 and 19, while the sub-wiring 44 is disposed between the insulating layers 16 and 17. Not only the main wiring 24, but the entire main line 20 is disposed between the insulating layers 18 and 19, while, not only the sub-wiring 44, but the entire sub-line 40 is disposed between the insulating layers 16 and 17, though they are not shown in FIG. 2B. In this manner, among the multiple insulating layers 16 through 19, the main line 20 and the sub-line 40 are disposed on different layers. This can decrease the distance between the main line 20 and the sub-line 40 while achieving the insulation therebetween by the insulating layers 17 and 18. It is thus possible to secure electromagnetic coupling between the main line 20 and the sub-line 40 and also to reduce the size of the directional coupler 10.

[1-2. Configuration of Variable Capacitor]

Figure 3:
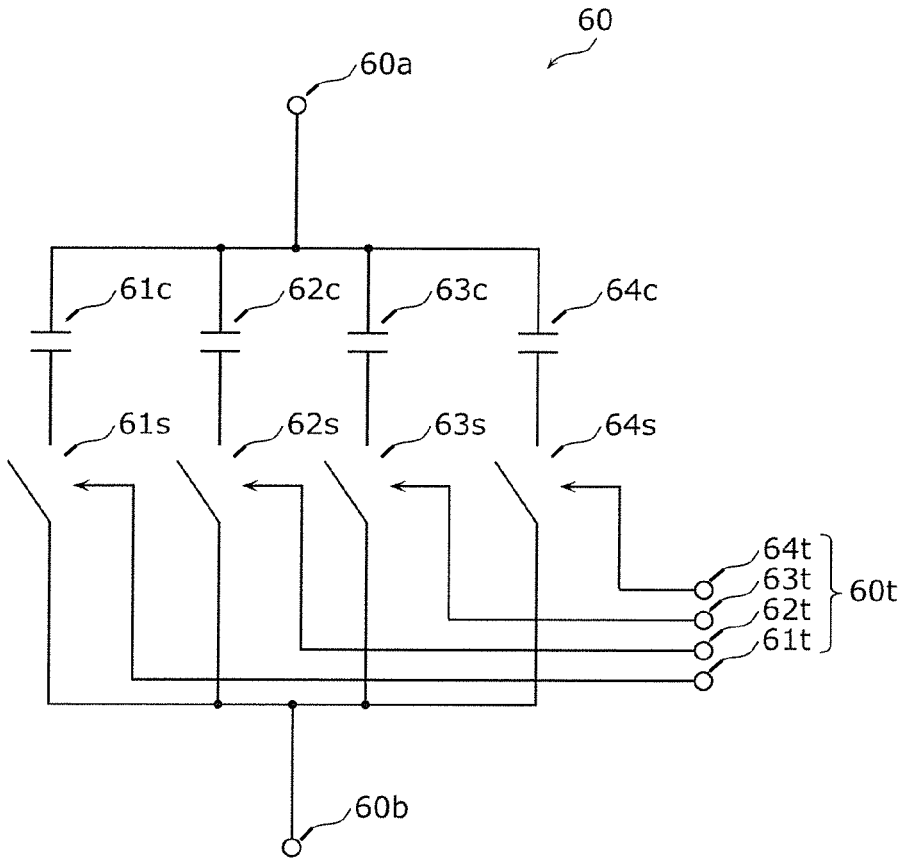
FIG. 3 is a circuit diagram illustrating the circuit configuration of a variable capacitor according to the first embodiment.

The configuration of the variable capacitor 60 will now be described below with reference to FIG. 3. FIG. 3 is a circuit diagram illustrating the circuit configuration of the variable capacitor 60 according to this embodiment. As shown in FIG. 3, the variable capacitor 60 includes plural capacitor elements connected in parallel with each other between the first and second input/output electrodes 60*a* and 60*b*. The number of capacitor elements is not particularly limited, and the variable capacitor 60 includes four capacitor elements 61*c* through 64*c* in this embodiment. The variable capacitor 60 also includes plural ON/OFF setting elements connected in series with the respective capacitor elements. In this embodiment, the variable capacitor 60 includes four ON/OFF setting elements 61*s* through 64*s*. The ON/OFF setting elements 61*s* through 64*s* are each constituted by a switch element that can switch between the ON/OFF states based on a control signal inputted from an external source. The switch elements forming the ON/OFF setting elements 61*s* through 64*s* are not restricted to a particular type and may be MOSFETs (Metal-Oxide Semiconductor Field-Effect Transistors). The control terminal 60*t* of the variable capacitor 60 has multiple input terminals. In this embodiment, the control terminal 60*t* has four input terminals 61*t* through 64*t* from which control signals are inputted into the respective four ON/OFF setting elements 61*s* through 64*s*. In response to control signals inputted into the input terminals 61*t* through 64*t* from an external source, the ON/OFF states of the ON/OFF setting elements 61*s* through 64*s* are switched.

In the variable capacitor 60 configured as shown in FIG. 3, the capacitance values of the capacitor elements 61*c*, 62*c*, 63*c*, and 64*c* are respectively set to be 0.1 pF, 0.2 pF, 0.4 pF, and 0.8 pF, for example. In this case, as a result of suitably switching between the ON/OFF states of each ON/OFF setting element, the capacitance of the variable capacitor 60 can be adjusted in a range of 0.1 to 1.5 pF in increments of 0.1 pF.

The capacitor elements of the variable capacitor 60 are not limited to a particular configuration. In this embodiment, each of the multiple capacitor elements of the variable capacitor 60 has a pair of opposing electrodes disposed on different layers among the multiple insulating layers 16 through 19 of the directional coupler 10. With this configuration, not only the main line 20 and the sub-line 40 of the directional coupler 10, but also the capacitor elements of the variable capacitor 60 are disposed within the insulating layers 16 through 19 on the substrate 15. This can further reduce the size of the directional coupler 10. Additionally, the distance between the variable capacitor 60 and each of the main line 20 and the sub-line 40 can be made smaller than when the variable capacitor 60 is disposed outside the plural insulating layers 16 through 19, thereby further reducing the length of the wiring 72 connecting the main line 20 and the variable capacitor 60 and that of the wiring 74 connecting the sub-line 40 and the variable capacitor 60. Accordingly, parasitic inductance in each of the wiring 72 and the wiring 74 can be reduced, which facilitates the adjustment of the degree of coupling of the directional coupler 10, thereby achieving an even stabler degree of coupling. Both of the opposing electrodes of each pair may be formed on one of the plural insulating layers 16 through 19.

[1-3. Advantages]

Figure 4:
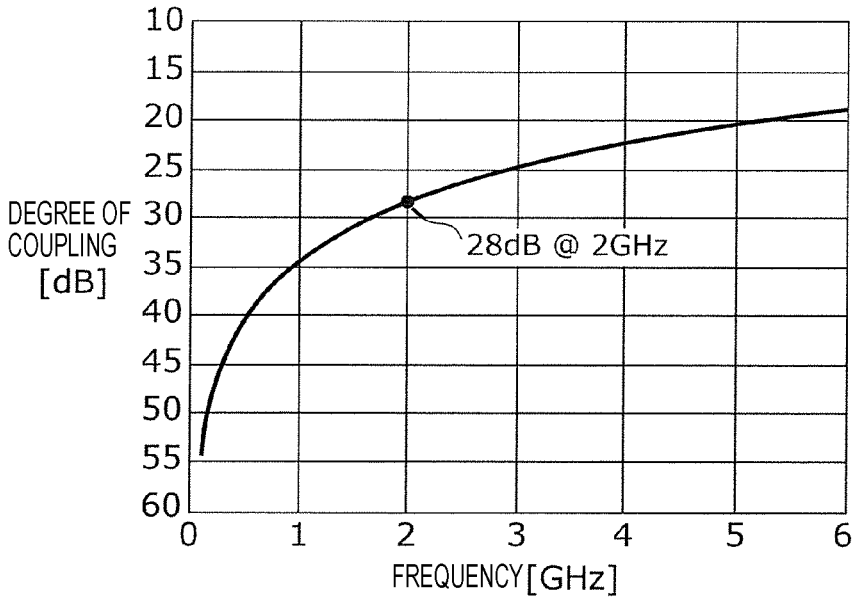
FIG. 4 is a graph illustrating the frequency characteristics of the degree of coupling of a directional coupler according to a comparative example.
Figure 5:
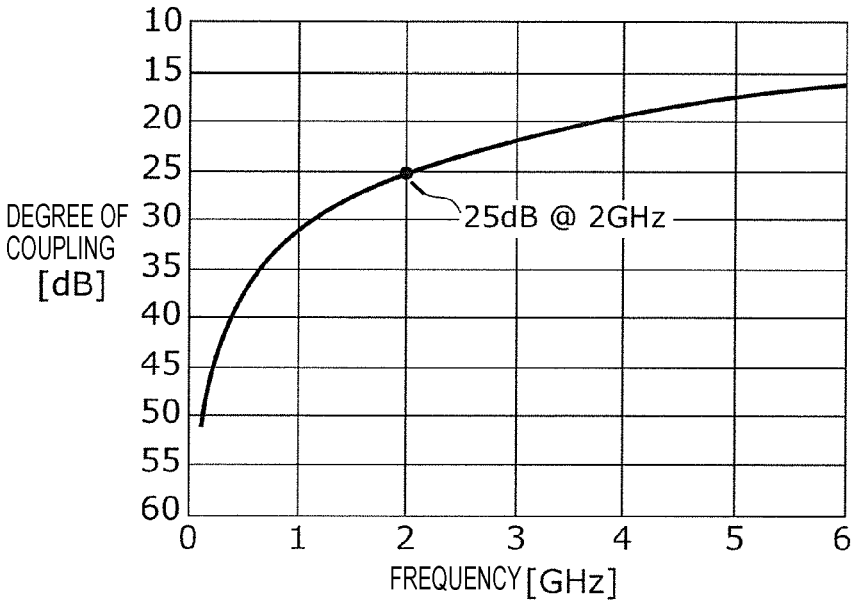
FIG. 5 is a graph illustrating the frequency characteristics of the degree of coupling of the directional coupler according to the first embodiment.

Advantages of the directional coupler 10 according to this embodiment will be described below with reference to FIGS. 4 and 5. FIG. 4 is a graph illustrating the frequency characteristics of the degree of coupling of a directional coupler according to a comparative example. FIG. 5 is a graph illustrating the frequency characteristics of the degree of coupling of the directional coupler according to this embodiment.

The directional coupler of the comparative example is similar to the directional coupler 10 of this embodiment, except that it does not include the variable capacitor 60.

FIGS. 4 and 5 show the calculation results of the degree of coupling in the directional coupler of the comparative example and those in the directional coupler of this embodiment obtained by simulations. The degree of coupling represents the ratio of power of radio-frequency signal outputted from one of the end portions of the sub-line 40 to that inputted into one of the end portions of the main line 20. As an example of this power ratio, the ratio of power of a radio-frequency signal outputted from the first end portion 42 of the sub-line 40 to that inputted into the input end portion 22 of the main line 20 is shown in FIGS. 4 and 5.

In the simulations conducted for determining the frequency characteristics shown in FIGS. 4 and 5, calculations were made for the degrees of coupling of the directional couplers which were designed so that the target value of the degree of coupling at a frequency of 2 GHz would be 25 dB. As shown in FIG. 4, the degree of coupling of the directional coupler of the comparative example is 28 dB, and the target degree of coupling is not achieved. This is due to a reduction in the degree of coupling because of resistor components of wiring, for example, connected to the sub-line of the directional coupler when the directional coupler is mounted.

In contrast, the directional coupler 10 of this embodiment achieves the target degree of coupling, as shown in FIG. 5. This is because the variable capacitor 60 can adjust the degree of coupling between the main line 20 and the sub-line 40.

In this manner, in the directional coupler 10 according to this embodiment, the degree of coupling between the main line 20 and the sub-line 40 can be adjusted by the variable capacitor 60. Hence, even with factors that may vary the degree of coupling, a stable degree of coupling can be obtained.

Second Embodiment

A module according to a second embodiment will be described below. The module of this embodiment is a module integrating the directional coupler 10 of the first embodiment and a control circuit for controlling the directional coupler 10 with each other. The module of this embodiment will be explained below with reference to FIG. 6.

Figure 6:
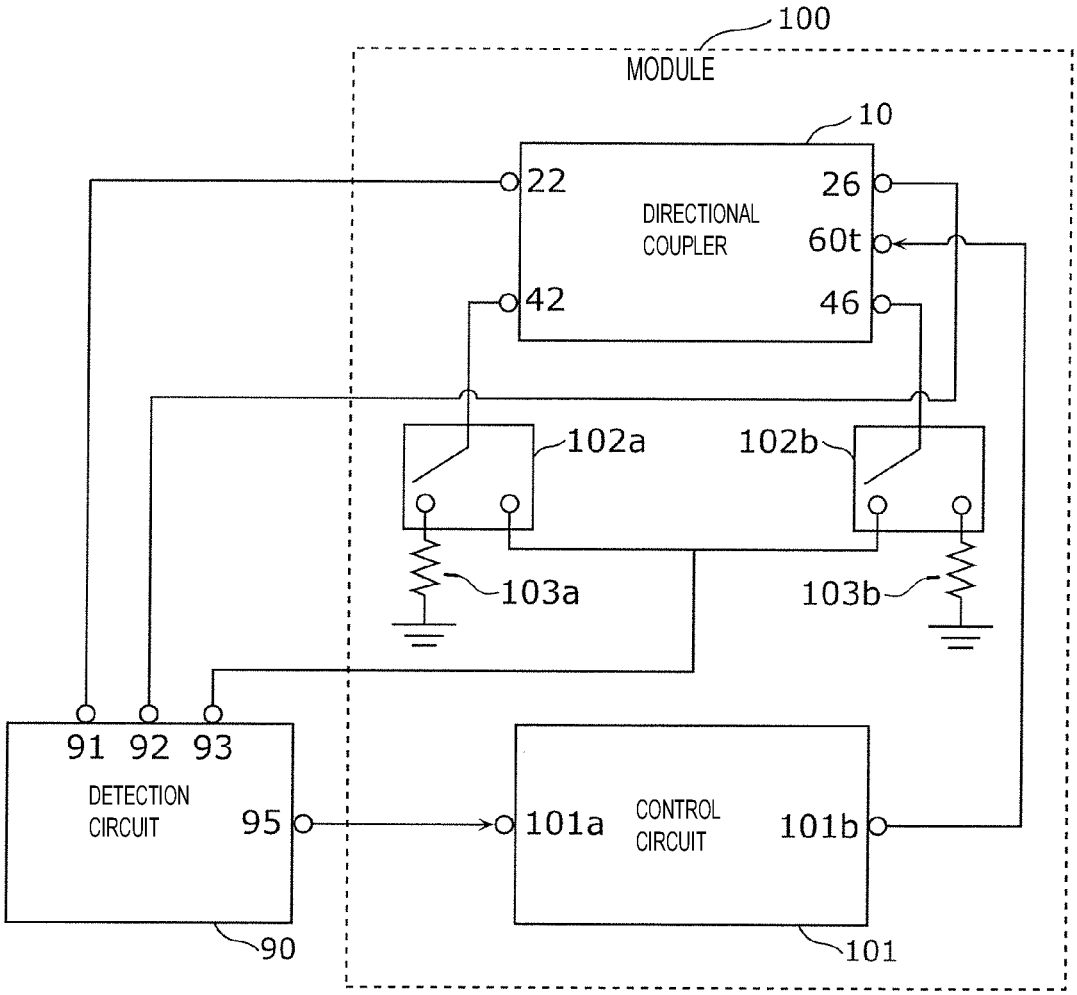
FIG. 6 is a block diagram illustrating the functional configuration of a module according to a second embodiment.

FIG. 6 is a block diagram illustrating the functional configuration of a module 100 according to this embodiment. In FIG. 6, a detection circuit 90 that detects the degree of coupling of the directional coupler 10 is also illustrated. As shown in FIG. 6, the module 100 of this embodiment includes the directional coupler 10 and a control circuit 101. In this embodiment, the module 100 also includes switch circuits 102*a* and 102*b*.

The control circuit 101 is a circuit that outputs a control signal for controlling the variable capacitor 60 of the directional coupler 10. More specifically, the control circuit 101 outputs a control signal to perform feedback control so that the actual value of the degree of coupling of the directional coupler 10 approaches the target value. The control circuit 101 may be an IC (Integrated Circuit) integrating this type of circuit. The control circuit 101 may store in advance a signal indicating the target value of the degree of coupling of the directional coupler 10. Alternatively, a signal indicating the target value may be inputted into the control circuit 101 from an external source.

The control circuit 101 includes an input terminal 101*a* and an output terminal 101*b*. The input terminal 101*a* receives a signal indicating the actual value of the degree of coupling of the directional coupler 10, for example. The output terminal 101*b* outputs a control signal.

The switch circuit 102*a* is a switch that switches between the connection/disconnection state between the first end portion 42 of the directional coupler 10 and a terminal 93 of the detection circuit 90. The switch circuit 102*b* is a switch that switches between the connection/disconnection states between the second end portion 46 of the directional coupler 10 and the terminal 93 of the detection circuit 90. The switch circuit 102*a* connects the first end portion 42 with the terminal 93 or one terminal of a terminating resistor 103*a*. The switch circuit 102*b* connects the second end portion 46 with the terminal 93 or one terminal of a terminating resistor 103*b*. The other terminals of the terminating resistors 103*a* and 103*b* are grounded. That is, as a result of operating the switch circuits 102*a* and 102*b*, when connecting the first end portion 42 to the terminal 93, the second end portion 46 is connected to the terminating resistor 103*b*, and when connecting the second end portion 46 to the terminal 93, the first end portion 42 is connected to the terminating resistor 103*a*.

The detection circuit 90 is a circuit that detects the degree of coupling of the directional coupler 10. The detection circuit 90 includes terminals 91, 92, and 93 and an output terminal 95. The terminal 91 is connected to the input end portion 22 of the directional coupler 10, while the terminal 92 is connected to the output end portion 26 of the directional coupler 10. The terminal 93 is connected to the switch circuits 102*a* and 102*b*. The detection circuit 90 outputs a test signal from the terminal 91 to the input end portion 22 of the directional coupler 10, and detects the characteristics of the directional coupler 10 based on the intensity of the test signal and that of each of signals inputted into the terminals 92 and 93. In this embodiment, the detection circuit 90 detects the degree of coupling, based on the intensity of a test signal outputted from the terminal 91 to the input end portion 22 of the directional coupler 10 and the intensity of a signal inputted from the first end portion 42 of the directional coupler 10 into the terminal 93 via the switch circuit 102*a*. The detection circuit 90 then outputs a signal corresponding to the detected degree of coupling from the output terminal 95 to the input terminal 101*a* of the control circuit 101.

The control circuit 101, the directional coupler 10, and the switch circuits 102*a* and 102*b* may be integrated into different ICs or into the same IC. If these elements are integrated into the same IC, the degree of coupling of the directional coupler 10 can be adjusted more easily than when they are integrated into different ICs.

By the use of the above-described module 100 and detection circuit 90, the degree of coupling of the directional coupler 10 can approach the target value. The module 100 of this embodiment includes the control circuit 101 that outputs a control signal for controlling the variable capacitor 60. By outputting a control signal from the control circuit 101, the module 100 can adjust the capacitance of the variable capacitor 60. It is thus possible to implement the module 100 that achieves a stable degree of coupling even with factors that may vary the degree of coupling.

Although the module 100 includes the switch circuits 102*a* and 102*b* in the above-described example discussed with reference to FIG. 6, the provision of the switch circuits 102*a* and 102*b* may be omitted. If the module 100 does not include the switch circuits 102*a* and 102*b*, a circuit having two terminals to be connected to the first end portion 42 and the second end portion 46, for example, may be used as a detection circuit. As a result of switching between a signal inputted into the terminal connected to the first end portion 42 and a signal inputted into the terminal connected to the second end portion 46 within the detection circuit, the capacitance of the variable capacitor 60 can be adjusted in a manner similar to the above-described example.

Other Embodiments

The directional coupler and the module according to the present disclosure have been discussed above through illustration of the embodiments. However, the present disclosure is not restricted to the above-described embodiments. Other embodiments implemented by combining certain elements in the above-described embodiments and modified examples obtained by making various modifications to the above-described embodiments by those skilled in the art without departing from the scope and spirit of the disclosure are also encompassed in the disclosure. Various devices integrating the directional coupler or the module according to the present disclosure are also encompassed in the disclosure.

Figure 7:
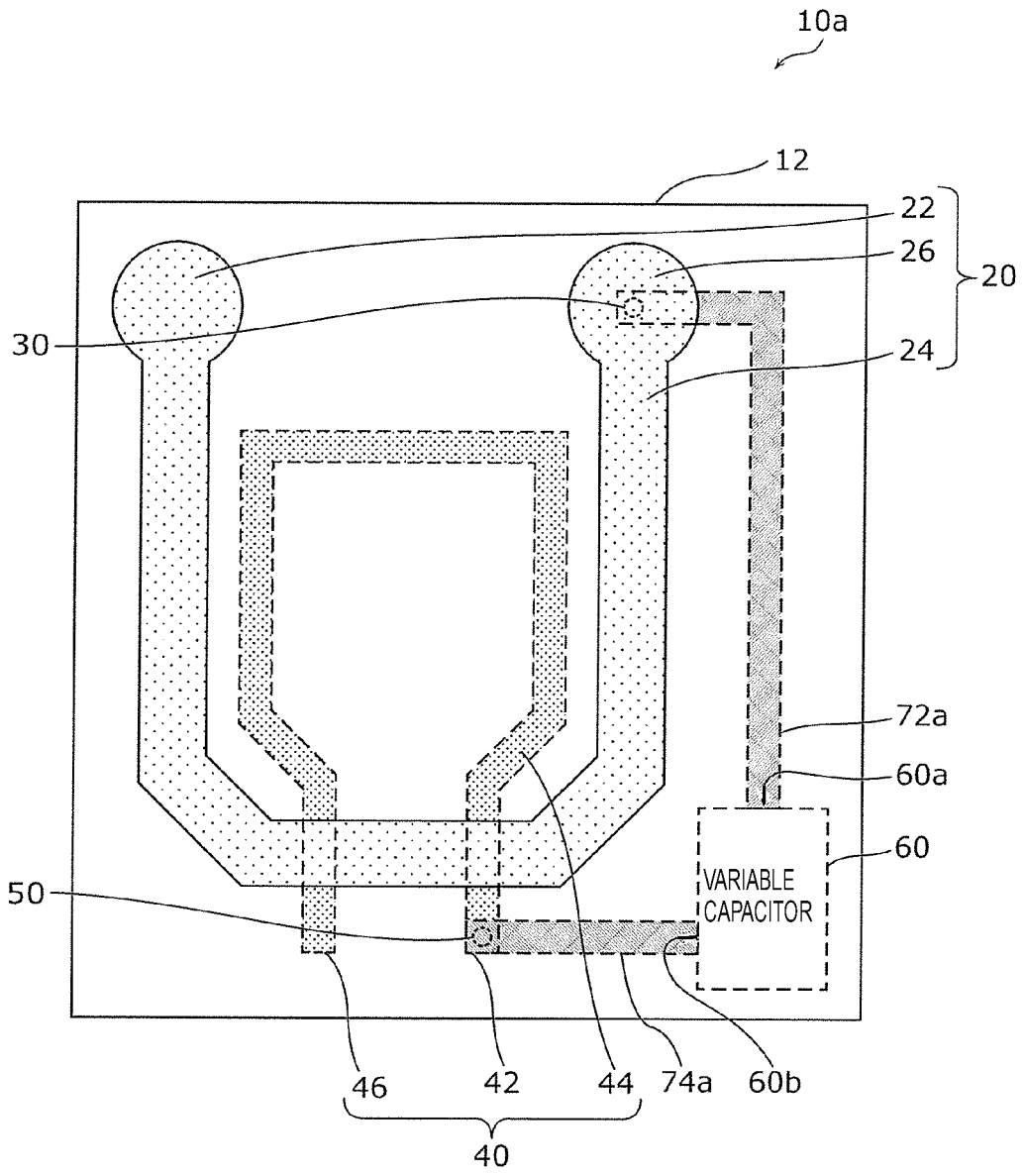
FIG. 7 is a schematic plan view illustrating the structure of a directional coupler according to a first modified example.

For example, in the first embodiment, the connection configuration and the positional arrangement of the variable capacitor 60 have been discussed through illustration of examples, but they are not restricted to these examples. Another example of the connection configuration and another example of the positional arrangement of the variable capacitor 60 will be discussed below with reference to FIG. 7. FIG. 7 is a schematic plan view illustrating the structure of a directional coupler 10*a* according to a first modified example. The directional coupler 10*a* of this modified example is similar to the directional coupler 10 of the first embodiment, except for the connection configuration and the positional arrangement of the variable capacitor 60.

As shown in FIG. 7, the variable capacitor 60 may be connected between the input end portion 22 of the main line 20 and the first end portion 42 of the sub-line 40 via wiring 72*a* and wiring 74*a*. In this manner, instead of connecting the variable capacitor 60 between the main wiring 24 and the sub-wiring 44, the variable capacitor 60 may be connected between a certain position of the main line 20 and a certain position of the sub-line 40.

As shown in FIG. 7, in the directional coupler 10*a* of this modified example, the variable capacitor 60 may be disposed outside a region sandwiched between the main line 20 and the sub-line 40.

In the directional coupler 10*a* according to this modified example, too, the degree of coupling between the main line 20 and the sub-line 40 can be adjusted by the variable capacitor. Hence, even with factors that may vary the degree of coupling, a stable degree of coupling can be obtained.

Figure 8:
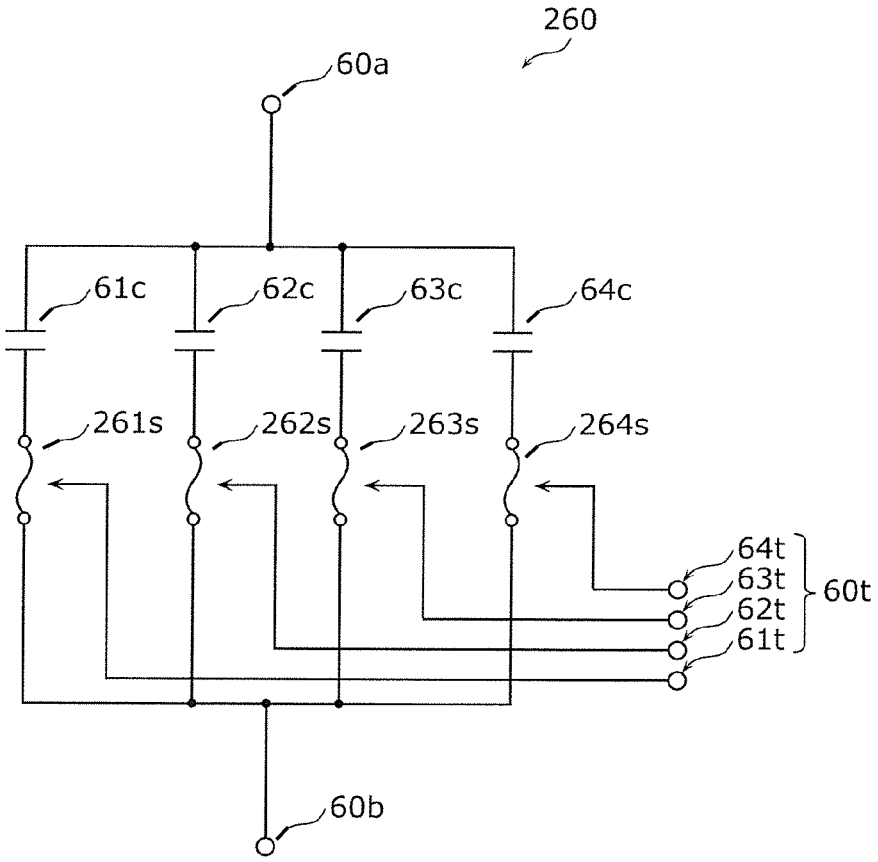
FIG. 8 is a circuit diagram illustrating the circuit configuration of a variable capacitor according to a second modified example.

In the first embodiment, as the ON/OFF setting elements in the variable capacitor 60, switch elements are used. However, the ON/OFF setting elements are not limited to switch elements. An example of the configuration of a variable capacitor using ON/OFF setting elements other than switch elements will be explained below with reference to FIG. 8. FIG. 8 is a circuit diagram illustrating the circuit configuration of a variable capacitor 260 according to a second modified example.

As shown in FIG. 8, the variable capacitor 260 of this modified example uses fuses as four ON/OFF setting elements 261*s* through 264*s*. These ON/OFF setting elements are melt-cut based on control signals, thereby changing the capacitance of the variable capacitor 260. Antifuses may alternatively be used as the ON/OFF setting elements.

The directional coupler and the module according to the present disclosure can be used in wireless communication mobile terminals, such as smartphones and tablet terminals, as a directional coupler and a module that achieve a stable degree of coupling.

10, 10*a* directional coupler
15 substrate
16, 17, 18, 19 insulating layer
20 main line
22 input end portion
24 main wiring
26 output end portion
30, 50 via-hole wiring
40 sub-line
42 first end portion
44 sub-wiring
46 second end portion
60, 260 variable capacitor
60*a* first input/output electrode
60*b* second input/output electrode
60*t* control terminal
61*c*, 62*c*, 63*c*, 64*c* capacitor element
61*s*, 62*s*, 63*s*, 64*s*, 261*s*, 262*s*, 263*s*, 264*s* ON/OFF setting element
61*t*, 62*t*, 63*t*, 64*t*, 101*a* input terminal
72, 72*a*, 74, 74*a* wiring
80 capacitor
90 detection circuit
91, 92, 93 terminal
95, 101*b* output terminal
100 module
101 control circuit
102*a*, 102*b* switch circuit
103*a*, 103*b* terminating resistor

The invention claimed is:

1. A directional coupler comprising:
a main line;
a sub-line, at least a part of the sub-line being disposed along the main line; and
a variable capacitor connected between the main line and the sub-line, the variable capacitor including a first input/output electrode and a second input/output electrode, wherein
the first input/output electrode and the second input/output electrode are connected to at least one of the main line and the sub-line,
the main line includes:
an input end portion being one end portion of the main line,
an output end portion being another end portion of the main line, and
a main wiring linking the input end portion and the output end portion;
the sub-line includes:
a first end portion being one end portion of the sub-line,
a second end portion being another end portion of the sub-line, and
a sub-wiring linking the first and second end portions;
the first input/output electrode is connected to the main wiring, and
the second input/output electrode is connected to the sub-wiring.

2. The directional coupler according to claim 1, further comprising:
a substrate, wherein
the main line, the sub-line, and the variable capacitor are directly or indirectly disposed on the substrate, and
in a plan view of the substrate, the variable capacitor is disposed in a region sandwiched between the main line and the sub-line.

3. The directional coupler according to claim 2, wherein:

the variable capacitor includes a control terminal into which a control signal is inputted; and a capacitance value of the variable capacitor is changed based on the control signal.

4. The directional coupler according to claim 2, further comprising:

a plurality of layers stacked on the substrate, wherein the main line and the sub-line are disposed on different layers of the plurality of layers.

5. The directional coupler according to claim 4, wherein:

the variable capacitor includes a control terminal into which a control signal is inputted; and a capacitance value of the variable capacitor is changed based on the control signal.

6. The directional coupler according to claim 4, wherein:

the variable capacitor includes a plurality of capacitor elements connected in parallel with each other; and each of the plurality of capacitor elements includes a pair of opposing electrodes, the opposing electrodes being disposed on one of the plurality of layers or different layers of the plurality of layers.

7. The directional coupler according to claim 6, wherein:

the variable capacitor includes a control terminal into which a control signal is inputted; and a capacitance value of the variable capacitor is changed based on the control signal.

8. The directional coupler according to claim 1, wherein:

the variable capacitor includes a control terminal into which a control signal is inputted; and a capacitance value of the variable capacitor is changed based on the control signal.

9. A module comprising:

the directional coupler according to claim 8; and a control circuit configured to output the control signal.

* * * * *